United States Patent [19]

Wataya

[11] 4,452,211

[45] Jun. 5, 1984

[54] AIR-FUEL RATIO CONTROL APPARATUS

[75] Inventor: Seiji Wataya, Hyogo, Japan

[73] Assignee: Mitsubishi Denki Kabushiki Kaisha, Hiroshima, Japan

[21] Appl. No.: 482,645

[22] Filed: Apr. 6, 1983

[30] Foreign Application Priority Data

Apr. 6, 1982 [JP] Japan ..... 57-58688

[51] Int. Cl.[3] ..... F02B 3/00

[52] U.S. Cl. ..... 123/492; 123/440

[58] Field of Search ..... 123/440, 492

[56] References Cited

U.S. PATENT DOCUMENTS

Re. 29,741 8/1978 Norimatsu ..... 123/440

4,359,029 11/1982 Furuhashi ..... 123/440

4,375,210 3/1983 Ohara ..... 123/440

4,375,211 3/1983 Ohara ..... 123/440

4,376,431 3/1983 Yokooku ..... 123/492

*Primary Examiner*—Ronald B. Cox

*Attorney, Agent, or Firm*—Sughrue, Mion, Zinn, Macpeak & Seas

[57] ABSTRACT

An air-fuel control apparatus is disclosed in which an error in the air-fuel ratio is corrected in a manner such that feedback control is performed at least once for a predetermined period during a high engine load operation mode, and such that operation in the high engine load mode is thereafter effected by open-loop control on the basis of results generated during feedback control.

1 Claim, 5 Drawing Figures

AIR-FUEL RATIO CONTROL APPARATUS

BACKGROUND OF THE INVENTION

The present invention relates to an air-fuel ratio control apparatus in which the air-fuel ratio is controlled by a feedback system as well as by an open-loop system.

Conventionally, in order to reduce harmful components in the exhaust gas of an engine, a method has been utilized in which such components in the exhaust gas are detected to effect feedback control to maintain a proper air-fuel ratio.

In this method, for example, as shown in FIG. 1, the existence of oxygen in exhaust components is detected by an exhaust component detector 3 provided in an exhaust pipe 100 of an engine 1, in order to control exhaust components so as to be maintained below a desired value.

Particularly, control is performed such that the basic fuel feed amount, which is determined in accordance with an output signal of an air quantity sensor 2 for detecting the intake air amount of the engine 1, is corrected on the basis of information obtained from the exhaust component detector 3, and a fuel control value 6 is controlled by means of a change-over device 11.

Since the output of the conventionally commonly used exhaust component detector 3 is reversed at the point of a stoichiometric air-fuel ratio of the exhaust components as shown in FIG. 2, integration is effected in a feedback control circuit 7 so that the fuel amount fed to the engine 1 from the fuel control valve 6 alternates between rich and lean, centering around an average value Qm.

Thus, the exhaust gas can be purified, since the air-fuel ratio is maintained in a range in which an exhaust emission control device can perform the purifying operation with optimum efficiency by feedback control of the air-fuel ratio.

On the other hand, in the control of a motor vehicle engine, there is also a range in which the output of the engine must take precedence over exhaust gas purification. For example, as shown in FIG. 3, it is common that, in accordance with the relation between the engine R.P.M. and the engine output, feedback control is normally used in zone FB, while in a high load region, i.e. a power enrich zone PE, open-loop control is performed.

For example, the load condition of the engine is determined by a load determination circuit 10 on the basis of signals obtained from the air quantity sensor 2 and an ignition device 5 which is in accordance with the engine R.P.M., and the change-over device 11 is switched to a fixed contact a in a low load state, and to the other fixed contact b in a high load state, in response to the output of the load determination circuit 10.

When the change-over device 11 is switched to the fixed contact a side, the air-fuel ratio is feedback controlled as described above, while when it is switched to the fixed contact b side, the fuel amount is open-loop controlled such that air-fuel ratio is controlled to a predetermined value by a control circuit 9.

In open-loop control, an error may be caused due to errors in the air quantity sensor 2, the fuel control valve 6, etc., and therefore, in order to correct this error, a feedback correction coefficient with respect to the basic fuel control amount during feedback control in the FB range is read and stored in a memory circuit 8 so as to perform open-loop control.

By using such means as described above, the initial error in and the change with time of fuel control valve 6 and/or the air quantity sensor 2 may be corrected to a certain extent. In the PE zone as shown in FIG. 3, however, since the correction is made on the basis of the results of feedback control in the FB zone, the correction is not always proper. This is because the operational range of each of the air quantity sensor 2 and the fuel control valve 6 varies between the FB and PE zones, and therefore in many cases the rate or tendency of error also varies so that the error cannot be completely corrected in the PE zone, making it impossible to prevent variations from occurring in the air-fuel ratio.

SUMMARY OF THE INVENTION

The present invention is intended to eliminate such conventional defects, and an object of the invention is to provide an air-fuel control apparatus in which an error in the air-fuel ratio is corrected such that feedback control is performed using an exhaust component detector under predetermined conditions even in the PE zone, and wherein open-loop control can be performed in the PE zone on the basis of the results during this feedback control.

DETAILED DESCRIPTION OF THE PREFERRED EMBODIMENTS

Figure 1:
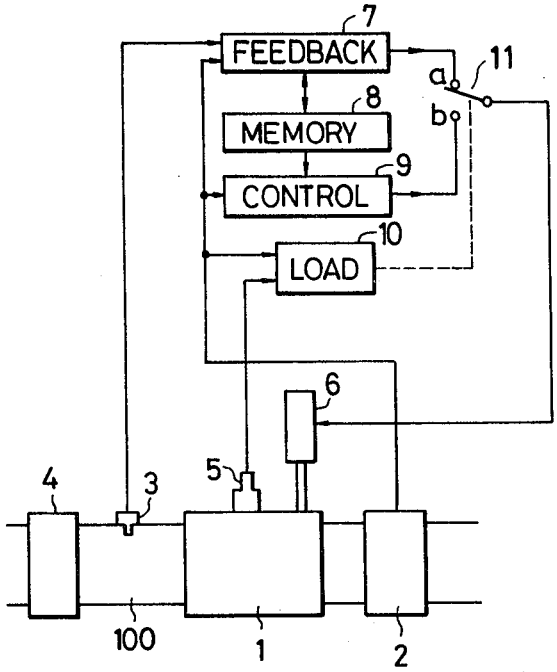
FIG. 1 is a block diagram illustrating the configuration of a conventional air-fuel control apparatus.
Figure 2:
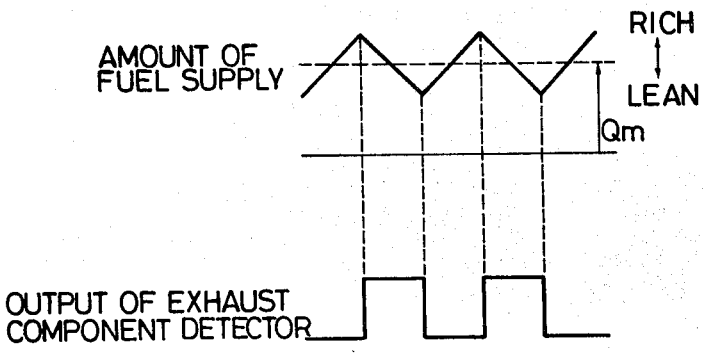
FIGS. 2 and 3 are diagrams explaining the operation of the air-fuel control apparatus according to the conventional technique and the present invention.
Figure 3:
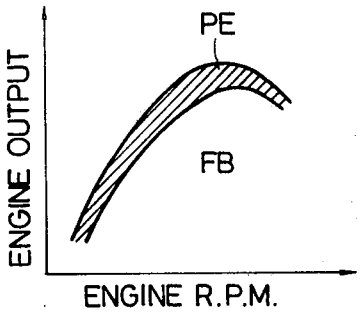
Figure 4:
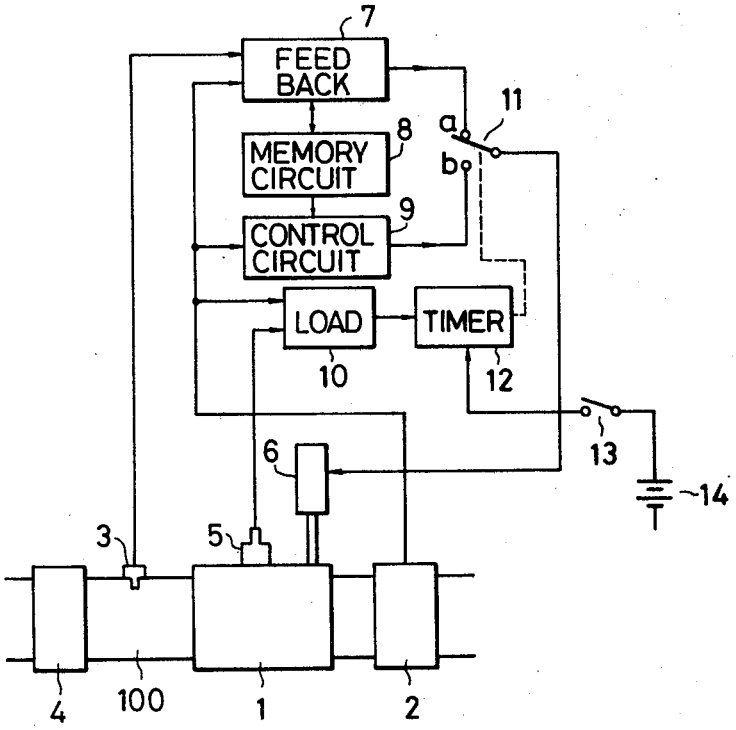
FIG. 4 is block diagram of the air-fuel control apparatus according to the present invention.

An embodiment of the present invention will now be described with reference to FIGS. 4 and 5. FIG. 4 is a block diagram illustrating the configuration of the embodiment, in which the same parts as in FIG. 1 are represented by the same reference numerals, and will not be described, therefore, in detail. As will be apparent from a comparison of FIG. 4 with FIG. 1, the parts represented by the reference numerals 1–10 and 100 in FIG. 4 are quite the same as those shown in FIG. 1, and the parts represented by reference numeral 12 et seq. are newly added according to the present invention.

That is, in FIG. 4, reference numeral 12 denotes a timer for controlling the time of performance of feedback control in the PE zone, and the output of the load determination circuit 10 is applied to this timer. The timer 12 is further connected through a switch 13 to the positive pole of a battery 14, the negative pole of the battery being connected to earth. The above-described change-over device 11 is switched by the timer 12.

The operation of the thus arranged air-fuel control apparatus according to the present invention will now be described by referring to the characteristic diagrams shown in FIGS. 5(*a*)–(*d*). After the start of the engine 1, the air-fuel ratio is open-loop (OPN) controlled in the period from $t_0$ to $t_1$ during which time the temperature of the exhaust gas is low as shown in FIG. 5(*d*) and a sufficient output cannot be obtained from the exhaust component detector 3.

When the engine has been sufficiently warmed up so that a sufficient output can be obtained from the exhaust component detector 3, feedback control is performed from time $t_1$. Thereafter, although the load determination circuit 10 detects a predetermined PE zone at the time $t_2$ with reference to the engine output, the timer 12 operates to cause the change-over device 11 to remain at the fixed contact a side for a predetermined period of time after the first time the PE zone is detected after the turning-on of the switch 13, so that feedback control is performed for the period from $t_2$ to $t_3$.

Figure 5:
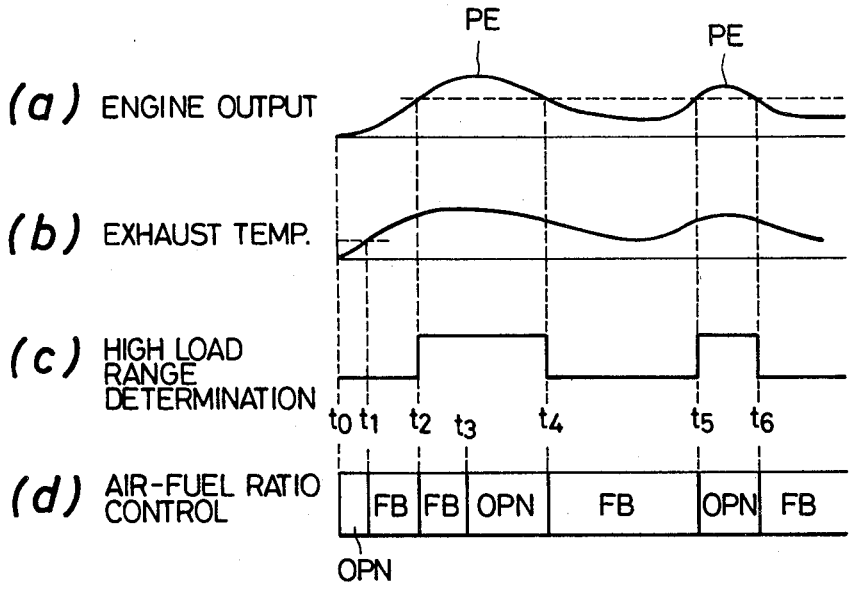
FIGS. 5(*a*)–(*d*) are characteristic diagrams explaining the operation of the air-fuel control apparatus according to the present invention.

After the time $t_3$, the output of the timer 12 causes the change-over device 11 to switch to the fixed contact b side so that open-loop control is performed by the control circuit 9 for the period from $t_3$ to $t_4$ such that the air-fuel ratio is made, as shown in FIG. 5(*d*), to be a predetermined value which is determined by reading out, from the memory circuit 8, a fuel control amount which has been subjected to correction of errors in the fuel control valve 6 and the engine 1 detected during feedback control in the period from $t_2$ to $t_3$, i.e. within the PE period.

Thus, when the engine is operated in the high load range after having been warmed up after the start thereof, the fuel amount is controlled so that the air-fuel ratio becomes the stoichiometric value on the basis of the output of the exhaust component detector 3, for a predetermined period of time at the beginning of the high load range, while absorbing errors in the system, and the fuel control amount at this time is stored. After the predetermined period of time has elapsed, an air-fuel ratio of a desired rich extent can be obtained by multiplying the stored fuel control amount by predetermined factor with the error suppressed to a minimum.

Although the air quantity sensor 2 is used as a means for detecting the load state of the engine 1, other means for detecting other indicative factors such as the pressure in the intake manifold can be alternatively used with the same effect.

As described above, in the air-fuel control apparatus according to the present invention, under predetermined conditions, feedback control is preformed even in the PE zone by detecting the exhaust components, and then open-loop control is performed in the PE zone on the basis of the results obtained during this feedback control so that the air-fuel ratio in the engine power-enrich region can be continuously corrected with an advantage in that the error in the air-fuel ratio can be minimized so that the maximum output of the engine can be obtained with an optimal fuel amount.

What is claimed is:

1. In an air-fuel ratio control apparatus for an internal combustion engine of a type including an exhaust component detector; means for detecting a high-load operating state of said internal combustion engine; a fuel flow control valve; a feedback circuit receiving inputs from said exhaust component detector and said high-load operating state detecting means; an open-loop control circuit comprising memory means for storing an output of said feedback circuit; control circuit means for producing on an output thereof a constant open-loop control signal at a level determined in accordance with an output of said memory means; and switch means operating in response to said output of said means for detecting said high-load state for coupling an output of said feedback circuit to operate said fuel flow control valve in a normal operating state and coupling an output of said open-loop control circuit to operate said fuel flow control valve in said high-load state, wherein the improvement comprises: means for delaying said output of said means for detecting said high-load state upon said output of said means for detecting said high-load state making a transition from a level corresponding to said normal state to a level corresponding to said high-load state, whereby said open-loop control circuit operates said fuel flow control valve in said high-load state in accordance with an output value of said feedback circuit produced in said high-load state such that errors in an air-fuel ration of said engine are minimized in said high-load state.

* * * * *

UNITED STATES PATENT AND TRADEMARK OFFICE

CERTIFICATE OF CORRECTION

PATENT NO. : 4,452,211

DATED : June 5, 1984

INVENTOR(S) : Seiji Wataya

It is certified that error appears in the above-identified patent and that said Letters Patent is hereby corrected as shown below:

Title page, Item [73]

Change Assignee from "Mitsubishi Denki Kabushiki Kaisha" to --Mitsubishi Denki Kabushiki Kaisha, Tokyo, Japan and Toyo Kogyo Co., Ltd, Hiroshima, Japan --.

Signed and Sealed this

Seventh Day of October, 1986

[SEAL]

*Attest:*

DONALD J. QUIGG

*Attesting Officer*

*Commissioner of Patents and Trademarks*